US010640911B2

(12) United States Patent
Bisaro

(10) Patent No.: US 10,640,911 B2
(45) Date of Patent: May 5, 2020

(54) LAUNDRY DRYING APPARATUS AND METHOD OF CONTROLLING A DRYING CYCLE IN A LAUNDRY DRYING APPARATUS

(71) Applicant: Electrolux Appliances Aktiebolag, Stockholm (SE)

(72) Inventor: Michele Bisaro, Spilimbergo (IT)

(73) Assignee: Electrolux Appliances Aktiebolag, Stockholm (SE)

( * ) Notice: Subject to any disclaimer, the term of this patent is extended or adjusted under 35 U.S.C. 154(b) by 521 days.

(21) Appl. No.: 15/321,764

(22) PCT Filed: Jun. 26, 2015

(86) PCT No.: PCT/EP2015/064519
§ 371 (c)(1),
(2) Date: Dec. 23, 2016

(87) PCT Pub. No.: WO2015/197816
PCT Pub. Date: Dec. 30, 2015

(65) Prior Publication Data

US 2017/0130389 A1 May 11, 2017

(30) Foreign Application Priority Data

Jun. 27, 2014 (EP) ..... 14174766

(51) Int. Cl.
*D06F 58/28* (2006.01)
*D06F 58/20* (2006.01)

(52) U.S. Cl.
CPC ..... *D06F 58/28* (2013.01); *D06F 58/203* (2013.01); *D06F 2058/2877* (2013.01); *D06F 2058/2896* (2013.01)

(58) Field of Classification Search
CPC ..... F26B 3/353; F26B 3/347; F26B 2210/02; H05B 3/60; B28B 11/243; Y02P 40/63;
(Continued)

(56) References Cited

U.S. PATENT DOCUMENTS 2,961,776 A 11/1960 Hughes
5,555,645 A 9/1996 Joslin
(Continued)

FOREIGN PATENT DOCUMENTS

CN 102482840 A 5/2012
CN 103046288 A 4/2013
(Continued)

OTHER PUBLICATIONS

English translation of Chinese Office Action for Chinese Application No. 201580027717.8, dated Jul. 9, 2018, 9 pages.

*Primary Examiner* — Jessica Yuen
(74) *Attorney, Agent, or Firm* — RatnerPrestia

(57) ABSTRACT

A method of controlling a drying cycle for drying delicate laundry in a laundry drying apparatus, in particular in a dryer or in a washer-dryer, wherein the laundry drying apparatus has a cabinet, a rotatable drum adapted to receive laundry to be dried, and a drying air channel arrangement designed to guide drying air through the drum for drying the laundry in the drum. The drying air is heated by a heating element and a blower is arranged in the channel arrangement adapted to convey the drying air. A drum motor is adapted to rotate the drum selectively in a main rotation direction (58) and in a counter rotation direction (66). The method includes a drying phase sequence (60) having a first drying phase (62) and subsequently a second drying phase (64). In the first drying phase (62) the drum is rotated alternately in the main and the counter rotation direction (58, 66) while the drying air is conveyed at a first average flow rate through the drum. In the second drying phase (64) the drum is rotated in the
(Continued)

main rotation direction (58) while the drying air is conveyed at a second average flow rate through the drum, wherein the first average flow rate is lower than the second average flow rate.

17 Claims, 2 Drawing Sheets

(58) Field of Classification Search
CPC ..... D06F 58/28; D06F 58/203; D06F 2058/2896; D06F 2058/2877; D06F 2058/289; D06F 2058/2864; D06F 2058/2854
See application file for complete search history.

(56) References Cited

U.S. PATENT DOCUMENTS

| | | | | |
|---|---|---|---|---|
| 9,637,859 | B2 | 5/2017 | Altinier et al. | |
| 9,803,306 | B2 | 10/2017 | Yoo et al. | |
| 2007/0209228 | A1* | 9/2007 | Meerpohl ..... | D06F 58/28 34/595 |
| 2012/0167636 | A1 | 7/2012 | Nakamoto et al. | |

FOREIGN PATENT DOCUMENTS

| | | | |
|---|---|---|---|
| CN | 103348058 | A | 10/2013 |
| EP | 1699971 | A2 | 9/2006 |
| EP | 1775368 | A1 | 4/2007 |
| EP | 1852541 | A1 | 11/2007 |
| EP | 2489777 | A1 | 8/2012 |
| WO | 2013167486 | A2 | 11/2013 |

* cited by examiner

LAUNDRY DRYING APPARATUS AND METHOD OF CONTROLLING A DRYING CYCLE IN A LAUNDRY DRYING APPARATUS

FIELD

The invention relates to a method of controlling a drying cycle for drying delicate laundry in a laundry drying apparatus, in particular in a dryer or in a washer dryer. Further the invention relates to a laundry drying apparatus having a control unit adapted to control the execution of a drying cycle.

BACKGROUND

EP 1 699 971 B1 discloses a laundry drying apparatus having a rotatable drum adapted to receive laundry to be dried. A control unit is provided to control the drying cycle. The drying cycle has an anti-crease phase in which the laundry is periodically moved and periodically not moved. The movement of the laundry during the anti-crease phase is dependent on specific parameters like progressing time, laundry temperature or residual humidity of the laundry. The anti-crease phase shall avoid creases in the laundry.

SUMMARY OF SELECTED INVENTIVE ASPECTS

It is an object of the invention to provide a method of controlling a drying cycle for drying delicate laundry in a laundry drying apparatus such that delicate laundry is treated gently. It is a further object of the invention to provide a laundry drying apparatus implementing the method.

A laundry drying apparatus—in the following description also denoted in brief "apparatus"—that is to be used for the invention comprises a cabinet and a drum adapted to receive laundry to be dried. The drum is rotatable supported in the cabinet. Furthermore, the apparatus comprises a drying air channel arrangement designed to guide drying air such that it passes through the drum for drying the laundry within the drum. A heating element is arranged in the channel arrangement for heating the drying air and a blower arranged in the channel arrangement is adapted to convey the drying air. A drum motor is adapted to rotate the drum selectively in a main rotation direction and in a counter rotation direction.

The method of an aspect of the invention provides controlling a drying cycle for drying delicate laundry comprising a predefined drying phase sequence having at least the following phases:

- a first drying phase in which the drum is rotated alternately in the main and the counter rotation direction while the drying air is conveyed at a first average flow rate through the drum, and subsequently
- a second drying phase in which the drum is rotated or mainly rotated in the main rotation direction while the drying air is conveyed at a second average flow rate through the drum.

Within this predefined drying phase sequence the first average flow rate is lower than the second average flow rate.

The drying phase sequence contributes to a smooth and gentle mechanical treatment of delicate laundry. The aforementioned rotation of the drum is able to control movements of the treated laundry such that delicate laundry will be dried gently and simultaneously creases can be avoided or at least reduced to a minimum.

During the second drying phase, the drum rotation is preferably such that the drum is rotating only or mainly in the main rotation direction.

Preferably, the drying cycle or drying program (which can be also denoted as "drying process") includes the drying phase sequence, i.e. the first and second drying phases, at least one time. Preferably, the whole drying phase sequence is executed at least five, ten, twenty or thirty times during the drying process.

The desired lower first average flow rate is preferably realized by a blower designed to have a conveying capacity which is reduced when the drum is rotated in counter rotation direction with a same rotation speed as in the main rotation direction and/or which is designed to convey less air in the forward blower conveyance direction than when operated with the same rotation speed in the rearward blower conveyance direction. In particular, a drum motor may simultaneously be the motor for driving the blower.

In reverse, the mechanical treatment or agitation of the delicate laundry is higher during the second drying phase due to the higher second average flow rate during the second drying phase. This succession of the different drum rotations and average flow rates supports avoiding creases in delicate laundry.

In an embodiment the heating element for heating the drying air is constituted for example as an electrical resistance heater or as a refrigerant cooling element (condenser) of a heat pump system in a heat pump laundry treatment apparatus.

A heat pump laundry treatment apparatus is particularly suitable or adapted to carry out the drying phase sequence for drying gently delicate laundry since this apparatus provides drying air with low temperature which supports smooth and gentle treatment of delicate laundry during the anti-crease phase.

The apparatus may be a vented dryer, however preferably the apparatus is a condensation dryer. Preferably the apparatus is a tumble dryer. The rotation axis of the drum is preferably a horizontal or essentially horizontal drum axis. Alternatively, the rotation axis of the drum is inclined relative to the horizontal plane by 5°-50°, preferably 10°-40°, particularly 20°-35°.

The aforementioned drying process is particularly suitable for gently treating all kind of delicate laundry, particularly silk. The delicate laundry can be defined in general as laundry requiring to be dried by lower or more delicate mechanical agitation than laundry in a usual drying process.

In a preferred embodiment, the drying cycle in general or the first drying phase or the second drying phase is ended, when one or more predetermined conditions is/are detected which indicate(s) the laundry status. The one or more predetermined conditions are preferably at least one of the following conditions:

- the laundry humidity is below a predetermined threshold,
- a parameter indicating laundry humidity is lower or equal to a set value,
- the temperature of the air exhausted out of the drum is higher than a set value,
- a temperature gradient of the air exhausted out of the drum is higher than a set value, and
- any other suitable physical parameter.

Preferably, a cooling phase is started when the one or more predetermined conditions is/are detected. Particularly, this cooling phase is a final portion of the whole drying cycle.

When the one or more predetermined conditions is/are detected, the heating element for heating the drying air may be automatically switched off or deactivated. Nevertheless, conveying air through the drum is preferably continued during the cooling phase.

Preferably, all or most rotation periods of the alternating main rotation direction and counter rotation direction during the first drying phase have a duration such that the drum is rotated less than 5 full turns or less than 3 full turns or less than 1 full turn or less than a half turn. The specific number of turns during a rotation period depends on the drum speed (rpm, rounds or turns per minute) and the defined time period. For example, one rotation period corresponds to a duration of 4 or 5 seconds. A preferred drum speed during the rotation period is 12 rpm. In another example, the duration of a rotation period is 2 seconds and the drum rotation speed during this rotation period is 54 rpm. This results in number of turns less than 2 turns, i.e. approximately 1.8 turns.

Defining rotation periods and/or the first drying phase by the aforementioned parameters allows shorter drum rotation times at lower drum rotation speed in both rotation directions (main and counter) thus providing a more delicate treatment of the laundry while enhancing its mechanical agitation and redistribution in the drum. This offers delicate laundry to be dried very gently in a shorter time.

In embodiments the first drying phase exhibits at least one of the following (alternative or additional) features:

- the total duration of drum rotation in the main or the counter rotation direction is longer than the total duration of drum rotation in the other rotation direction,
- the duration of all or at least most of the periods of drum rotation in the main or the counter rotation direction is longer than the duration of all or at least most of the periods of drum rotation in the other rotation direction, and
- the number of periods of drum rotation in the main or the counter rotation direction is higher than the number of periods of drum rotation in the other direction.

This asymmetric or unequal drum rotation in one of both rotation directions (main and counter) supports improved laundry distribution in the drum.

Preferably the maximum drum rotation speed during the second drying phase is higher than the maximum drum rotation speed during the first drying phase. Such a drum rotation control during the drying phase sequence provides enhanced treatment of delicate laundry to be dried.

Preferably, the maximum drum rotation speed in the first drying phase is

- equal to or below 20, 15, 10, 8 or 5 rpm, and/or
- 0.5, 0.3 or 0.2 of the maximum drum rotation speed of the second drying phase.

Preferably, the maximum drum rotation speed in the second drying phase is

- below the satellization speed, and/or
- equal to or below 60, 54, 50, 45 or 40 rpm.

The satellization speed is the speed where laundry adheres to the drum wall during drum rotation.

In an embodiment the drying air channel arrangement of a drying apparatus according to the invention is designed such that the drying air is guided from at least one drum outlet to at least one drum inlet in such a manner that the drum and the drying air channel form a drying air loop. Preferably such arrangement is used in a condenser-type and/or heat-pump system dryer.

Preferably, a cooling phase for cooling the delicate laundry during a final portion of the drying cycle is provided and/or an anti-crease phase after the drying cycle is provided. In this cooling phase and/or anti-crease phase, a so called third phase is applied (executed) in which the drum is rotated alternately in the main and the counter rotation direction while the drying air is conveyed at the first average flow rate through the drum or at another average flow rate lower than the second average flow rate. Applying such a third phase supports the aim of a drying cycle to dry the laundry according to a predetermined condition, e.g. according to a predetermined humidity level like cupboard dry, ironing dry or damp.

The cooling phase may be considered as part of the drying cycle, whereas the anti-crease phase may be considered as an additional cycle. This additional cycle is executed preferably automatically if the laundry is detected as not being removed by the user.

Preferably, the third phase is or is essentially like or similar to the first drying phase. Particularly, the third phase has the same or essentially the same physical parameters like the aforementioned first drying phase. In further embodiments, the third phase is executed repetitively during the cooling phase and/or anti-crease phase periodically or from time to time.

In an embodiment, a cooling phase for cooling the delicate laundry during a final portion of the drying cycle is provided and/or an anti-crease phase after the drying cycle is provided, wherein a so called fourth phase is applied in this cooling phase and/or anti-crease phase. In the fourth phase the drum is rotated or at least mainly rotated in the main rotation direction while the drying air is conveyed at the second average flow rate through the drum or at another average flow rate higher than the first average flow rate.

Preferably, the fourth phase is or is essentially like or similar to the second drying phase. Particularly, the fourth phase has the same or essentially the same physical parameters like the aforementioned second drying phase. In further embodiments, the fourth phase is executed repetitively during the cooling phase and/or anti-crease phase periodically or from time to time.

Preferably during the cooling phase and/or anti-crease phase, both the third and fourth phases are applied. Preferably the third/fourth phases are repeated as the repetition of the first/second phase.

At least a portion of the drying phase sequence, particularly the whole drying phase sequence, can be executed in an anti-crease phase of the drying cycle. The drying phase sequence can be regarded as a part of an anti-crease phase. In particular, an anti-crease phase is constituted by the drying phase sequence. Preferably, the drying phase sequence is executed repetitively during the drying cycle, in particular during the anti-crease phase.

Especially,—and apart from the heating element controlled to be switched off or deactivated—all parameters (e.g. maximum drum rotation speed, rotation period, etc.) applied for the first and second drying phase are also applicable for the third and fourth phase, respectively.

In a preferred embodiment the duration of the fourth phase is shorter than the duration of the second drying phase. Particularly, the ratio of the duration of the fourth phase to the duration of the second drying phase is equal to or below 0.5, 0.4, 0.2, 0.1, 0.05 or 0.02. For example, the duration of the fourth phase is or is about 180, 120, 100, 80, 60, 50 or 40 seconds.

Preferably, the heating element is switched off or deactivated in a cooling phase for cooling the delicate laundry during the final portion of the drying cycle or during an anti-crease phase after the drying cycle.

The heating element is preferably switched off or operated at reduced power during the first drying phase or at least temporarily during the first drying phase. Due to such control of the heating element, potential overheating of the temperature sensitive delicate laundry (particularly silk) is prevented in a facile technical manner. Such control is especially beneficial in case of an electric heater because the state of switch off or reduced power is able to be achieved very fast even if the generated temperature for heating the drying air was relative high. In case the apparatus contains a heat pump system having a compressor, controlling of the compressor would preferably continuously operate as the temperature of the drying air entering the drum is relative low (e.g. 50-55° C.). Insofar here potential overheating of delicate laundry is avoided.

In a further preferred embodiment, a drying apparatus according to the invention comprises a heat pump system having a refrigerant cooling element (e.g. a condenser) as the heating element for heating the drying air. Further this heat pump system has a refrigerant heating element for cooling the drying air arranged in the drying air channel arrangement upstream the heating element. The compressor of the heat pump system is preferably switched off during the cooling phase and/or anti-crease phase. The residual drying capacity of the refrigerant is used in an energy-saving manner in the cooling phase.

In another embodiment the drum rotation is stopped during the first drying phase for defined time periods between a reversal between rotation in main rotation direction and counter rotation direction. This stopped drum rotation period (also denotable as "stop period") is not executed necessarily between all drum rotation reversals but in a preferred embodiment between at least most drum rotation reversals during the first drying phase. Particularly, the stop period has a duration of at least 1, 2, 3, 5, 8 or 10 seconds.

As already mentioned, the delicate laundry, on which the inventive method of the present invention is applied, is particularly silk. Preferably, the method according to the invention is activated or selected to be performed in a drying apparatus through an input unit adapted to receive a request or input by a user to activate a delicate, particularly silk, drying treatment program. This delicate, particularly silk, drying treatment program includes controlling the apparatus according to the method having any of the aforementioned features.

The drum motor adapted to rotate the drum is preferably a controllable speed motor such that, in the method according to the invention, the drum may be rotated at different predetermined speeds by a control unit. Thus, the described first, second, third and fourth phases can be precisely executed in a facile manner.

In order to support the efficiency of the laundry treatment, the blower of a drying apparatus according to the invention is designed such that the conveyance capacity of the blower is higher when the blower is rotated in the forward direction as compared to rotation at the same speed in the backward direction. The drum motor may be simultaneously used as the motor for rotating the blower. In this regard, the main rotation direction of the drum corresponds to the forward direction of the blower.

According to another aspect of the invention, a laundry drying apparatus (in particular a dryer or washer-dryer) is provided and is generally adapted to implement or carry out a drying cycle. Particularly, this laundry drying apparatus (in brief denotable again "apparatus") has a control unit programmed for carrying out a drying cycle according to any of the above or below described aspects of the method. This apparatus may have individually or in combination any feature(s) disclosed in conjunction with the description and/or the figures.

Preferably, this laundry drying apparatus comprises a cabinet and a drum adapted to receive laundry to be dried, wherein the drum is rotatable supported in the cabinet. A drying air channel arrangement is designed to guide drying air such that it passes through the drum for drying the laundry in the drum. A heating element is arranged in the channel arrangement for heating the drying air and a blower is arranged in the channel arrangement adapted to convey the drying air. A drum motor is adapted to rotate the drum selectively in a main rotation direction and in a counter rotation direction.

Additionally, the drying apparatus comprises a control unit particularly adapted, i.e. programmed, to control the execution of at least one drying cycle according to the method of the present invention. In particular, the execution of said at least one drying cycle has at least one drying phase sequence with a first and a second drying phase. In the first drying phase the control unit controls the drum motor to rotate the drum alternately in the main and the counter rotation direction, and to control the blower such that the drying air is conveyed at a first average flow rate through the drum. In the second drying phase the control unit controls the drum motor to rotate or mainly rotate the drum in the main rotation direction, and to control the blower such that the drying air is conveyed at a second average flow rate through the drum, wherein the first average flow rate is lower than the second average flow rate.

An apparatus configured in the aforementioned way and/or having a control unit implementing any of the aforementioned method features provides the advantages as described above and/or below. In particular the apparatus provides a more efficient or improved operation with respect to the desired gentle treatment of delicate laundry.

BRIEF DESCRIPTION OF THE DRAWINGS

Reference is made in detail to preferred embodiments of the invention, an example of which is illustrated in the accompanying figures which show.

DETAILED DESCRIPTION OF EXAMPLE EMBODIMENTS

Figure 1:
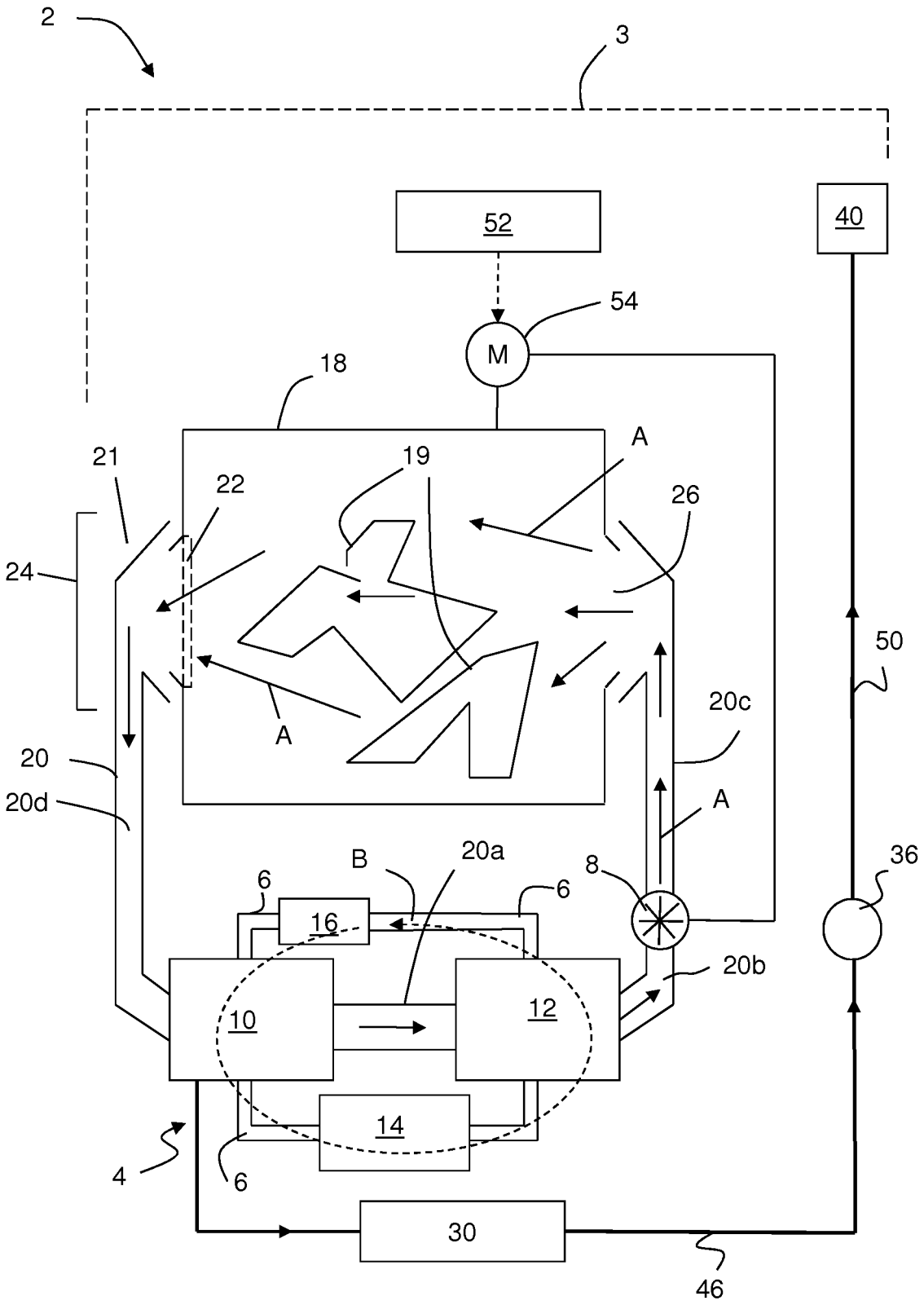
FIG. 1 a schematic view of a laundry treatment apparatus.

FIG. 1 shows a schematically depicted laundry drying apparatus 2 which in brief is denoted "apparatus" and in this embodiment is a heat pump tumble dryer. The tumble dryer 2 comprises a partly and schematically depicted cabinet 3 which supports or encloses several components and parts described hereinafter. The cabinet 3 encloses a heat pump system 4, including a closed refrigerant loop 6 which comprises in the following order of refrigerant flow B: a first heat exchanger 10 acting as evaporator for evaporating the refrigerant and cooling drying air, a compressor 14, a second heat exchanger 12 acting as condenser for cooling the refrigerant and heating the drying air, and an expansion device 16 from where the refrigerant is returned to the first heat exchanger 10. Together with the refrigerant pipes connecting the components of the heat pump system 4 in series, the heat pump system 4 forms the refrigerant loop 6 through which the refrigerant is circulated by the compressor 14 as indicated by arrow B.

The drying air flow within the apparatus 2 is guided through a compartment 18, e.g. a laundry drum, of the home appliance 2, i.e. through a compartment for receiving articles to be treated. The articles to be treated are textiles, particularly delicate laundry 19, or the like. The drying air flow is indicated by arrows A in FIG. 1 and is driven by a drying air blower 8. A drying air channel 20 guides the drying air flow A outside the drum 18 and includes different sections, including the section forming a battery channel 20*a* in which the first and second heat exchangers 10, 12 are arranged. The drying air exiting the second heat exchanger 12 flows into a rear channel 20*b* in which the drying air blower 8 is arranged. The air conveyed by the blower 8 is guided upward in a rising channel 20*c* to the backside (which has a kind of drum inlet 26) of the drum 18. The air exiting the drum 18 through the drum outlet (which is the loading opening 21 of the drum and which is covered by a door 24) is filtered by a fluff filter 22 arranged close to the drum outlet in or at the channel 20. The optional fluff filter 22 is arranged in a front channel 20*d* forming another section of channel 20 which is arranged behind and adjacent the front cover of the apparatus 2. The condensate formed at the first heat exchanger 10 is collected and guided to a condensate collector 30 which is connected to an extractable condensate drawer 40 via a drain pipe 46, a drain pump 36 and a drawer pipe 50. The collected condensate can be pumped from the collector 30 to the drawer 40 which is arranged at an upper portion of the apparatus 2 from where it can be comfortably withdrawn and emptied by a user.

As shown in FIG. 1, a control unit 52 is disposed in the cabinet 3 of the apparatus 2 to control the execution of specific drying cycles. In this regard, the control unit 52 is adapted to control a drum motor 54. This drum motor 54 is adapted to rotate the drum 18 selectively in a main rotation direction and in a counter rotation direction. Simultaneously, the drum motor 54 is acting a blower motor driving the blower 8.

Preferably the control unit 52 is at the same time the control unit for controlling and monitoring the overall operation of the apparatus 2. The tumble dryer 2 according to FIG. 1 is able to execute the above and below described method features and method steps under the control of the control unit 52.

Figure 2:
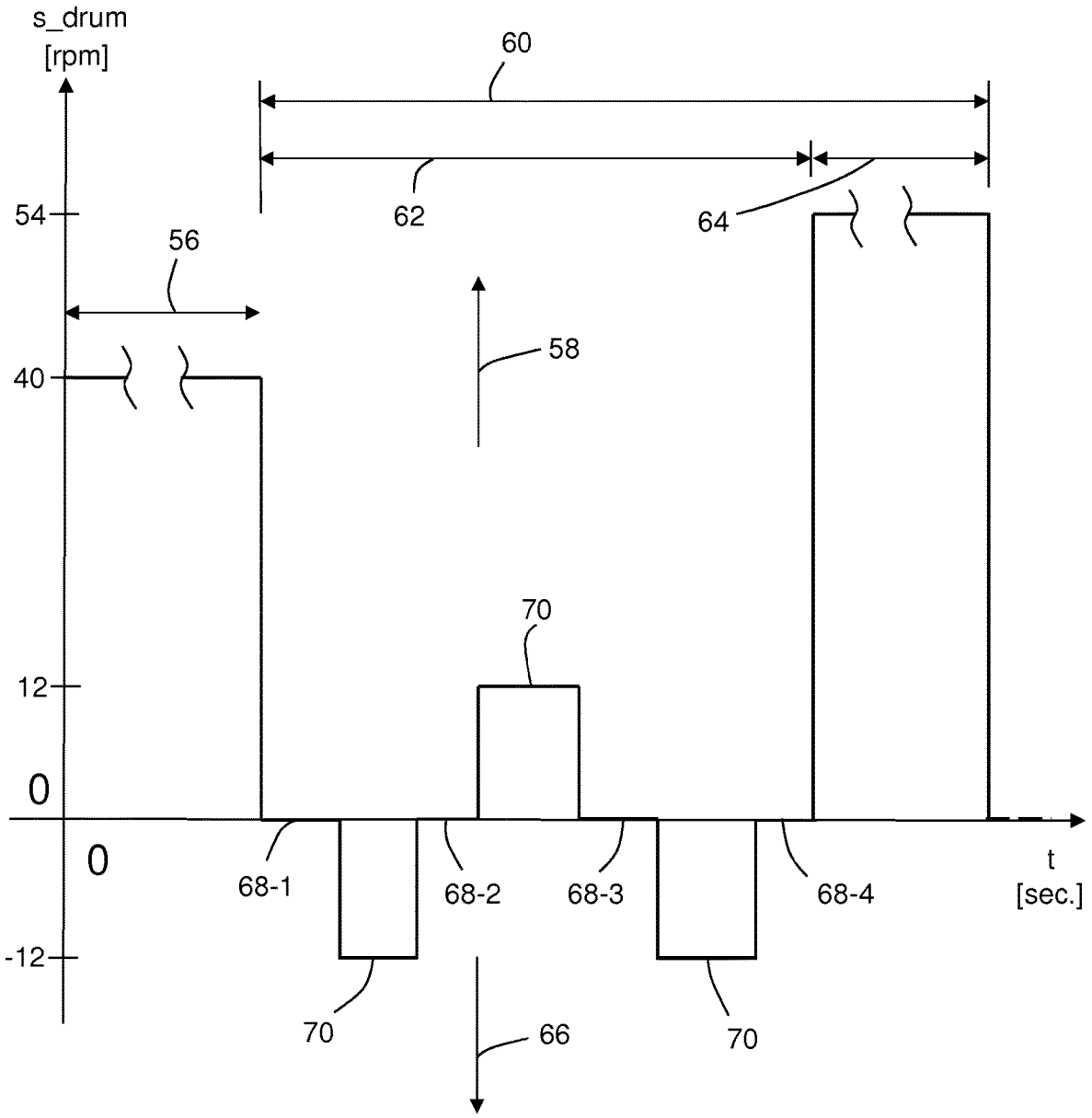
FIG. 2 a diagram showing changes of drum rotation in relation to the time during a drying cycle.

As shown in FIG. 2, a specific drying cycle is starting at the time t=0. In a first portion 56 of this drying cycle, the drum 18 is rotated in the main rotation direction 58 at the drum rotation speed s_drum=40 rpm (rounds per minute). In this example, the first portion 56 has a duration of 76 seconds. This first portion 56 is followed by a drying phase sequence 60 which is divided in a first drying phase 62 and a subsequent second drying phase 64. During the first drying phase 62 the drum 18 is rotated alternately in the main rotation direction 58 and in the counter rotation direction 66. During the second drying phase 64 the drum 18 is rotated only in the main rotation direction 58 in the example of the detailed embodiment.

Regarding the drying air flow A, the drying air A is conveyed at a first average flow rate through the drum 18 when the first drying phase 62 is executed. When the second drying phase 64 is executed, the drying air A is conveyed at a second average flow rate through the drum 18, wherein the first average flow rate is lower than the second average flow rate.

In the detailed embodiment, the reduced flow rate is achieved by reduced ratio of rotating the drum in the main rotation direction. Due to driving the blower 8 with the drum motor 54 and due to a higher conveyance capacity of the blower in the forward direction (when the drum is rotating in main rotation direction), when the ratio of drum rotation in the main rotation direction is lower, the blower conveyance capacity is also lower. In other embodiments the blower may be driven independently of the drum and the control unit 52 may control the blower operation such that there is a lower average air flow in the first drying phase. In another embodiment the blower may have same or similar conveyance capacity in forward and backward direction and may be driven by the drum motor, however by alternating in the main and counter rotation direction, the repeatedly reverting air flow direction is at least partially mutually extinguishing due to respective counter-inertia.

The first drying phase 62 and/or the second drying phase 64 may be ended when one or more predetermined conditions is/are detected. This at least one predetermined condition may indicate a laundry status or is the termination of set time period(s).

The first drying phase 62 has several stop periods 68 in which rotation of the drum 18 is stopped for specific time periods between rotation reversals from the main rotation direction 58 to the counter rotation direction 66 and vice versa.

In the present example, the time durations, the allocated drum speeds and rotation directions are as follows:

- The first portion 56 has a duration of 76 seconds, in which the drum 18 is rotating in the main rotation direction 58 at a drum speed s_drum=40 rpm.
- The subsequent first drying phase begins with a first stop period 68-1 having a duration of 4 seconds.
- When the first stop period 68-1 is terminated, a rotation period 70 having a duration of 4 seconds is executed where the drum 18 is rotated reversed, i.e. in the counter rotation direction 66 at a drum speed s_drum=−12 rpm.
- This rotation period 70 is followed by a second stop period 68-2 having a duration of 3 seconds.
- Afterwards, a further rotation period 70 having a duration of 5 seconds is executed. During this rotation period 70 the drum is rotated for 5 seconds reversed again, i.e. in the main rotation direction 58 at a drum speed s_drum=12 rpm.
- Terminating this rotation period 70 of 5 seconds, a third stop period 68-3 is executed for a duration of 4 seconds.
- When the third stop period 68-3 is terminated, the drum 18 is rotated reversed again, i.e. in the counter rotation direction 66 at a drum speed s_drum=−12 rpm, wherein the rotation period 70 has a duration of 5 seconds.
- The latter rotation period 70 is followed by a fourth stop period 68-4 having a duration of 3 seconds.
- The first drying phase 62 is ended when the fourth stop period 68-4 is terminated. Then, the second drying phase 64 is started. The second drying phase 64 has a duration of 60 seconds, wherein the drum 18 is rotated in the main rotation direction 58 at a drum speed s_drum=54 rpm.

The above sequences, time durations, rotation speeds, provision of stop periods are exemplary only.

The described first drying phase 62 has an overall duration of 28 seconds. During this first drying phase 62 the total duration of drum rotation in the counter rotation direction 66 is longer (=9 seconds) than the total duration of drum rotation in the main rotation direction 58 (=5 seconds). The duration of the rotation period 70 in the main rotation direction 58 is longer (=5 seconds) than the duration of the first rotation period 70 in the counter rotation direction 66 (=4 seconds). The number of rotation periods 70 rotating the drum 18 in counter rotation direction 66 is higher (i.e. two rotation periods 70) than the number of rotation periods 70 rotating the drum 18 in main rotation direction 58 (i.e. one rotation period).

Preferably, this whole drying phase sequence 60 is repeated immediately one time or several times till the end of the whole drying cycle. Alternatively, a repeated drying phase sequence is executed only in part. A final portion of the drying cycle may be constituted as a cooling phase for cooling the delicate laundry. Alternatively or additionally, an anti-crease phase for treating the delicate laundry may be executed after the drying cycle.

The proposed drying phase sequence 60 is able to provide a more gently and smooth treatment of delicate laundry during a drying cycle in order to achieve dried and crease-resistant delicate laundry like silk. On the other hand, the delicate laundry is particularly gently dried in a shorter time.

| Reference Numeral List: | |
|---|---|
| 2 | tumble dryer |
| 3 | cabinet |
| 4 | heat pump system |
| 6 | refrigerant loop |
| 8 | blower |
| 10 | first heat exchanger |
| 12 | second heat exchanger |
| 14 | compressor |
| 16 | expansion device |
| 18 | drum |
| 19 | laundry |
| 20 | drying air channel |
| 20a | battery channel |
| 20b | rear channel |
| 20c | rising channel |
| 20d | front channel |
| 21 | loading opening |
| 22 | filter element |
| 24 | door |
| 26 | drum inlet |
| 30 | condensate collector |
| 36 | drain pump |
| 40 | condensate container |
| 46 | drain pipe |
| 50 | drawer pipe |
| 52 | control unit |
| 54 | motor |
| 56 | first portion |
| 58 | main rotation direction |
| 60 | drying phase sequence |
| 62 | first drying phase |
| 64 | second drying phase |
| 66 | counter rotation direction |
| 68-1 | first stop period |
| 68-2 | second stop period |
| 68-3 | third stop period |
| 68-4 | fourth stop period |
| A | drying air flow |
| B | refrigerant flow |
| s_drum | drum rotation speed |
| t | time |

The invention claimed is:

1. A method of controlling a drying cycle for drying delicate laundry in a laundry drying apparatus, wherein the drying apparatus comprises:

a cabinet, a drum adapted to receive laundry to be dried, wherein the drum is rotatably supported in the cabinet, a drying air channel arranged to guide drying air (A) such that it passes through the drum for drying the laundry in the drum, a heating element arranged in the drying air channel for heating the drying air (A), a blower arranged in the drying air channel arrangement adapted to convey the drying air (A), and a drum motor adapted to rotate the drum selectively in a main rotation direction and in a counter rotation direction, wherein the method comprises a drying cycle including a first portion in which the drum is rotated in the main rotation direction, and a drying phase sequence portion comprising the following drying phase sequence:

a first drying phase of the drying phase sequence portion in which the drum is rotated alternately in the main rotation direction and the counter rotation direction while the drying air (A) is conveyed at a first average flow rate through the drum, and subsequently a second drying phase of the drying phase sequence portion in which the drum is rotated only in the main rotation direction while the drying air (A) is conveyed at a second average flow rate through the drum, wherein the first average flow rate is lower than the second average flow rate, wherein after the drying phase sequence portion of the drying cycle, an anti-crease phase is applied in which the drum is rotated alternately in the main and the counter rotation direction while the drying air (A) is conveyed at the first average flow rate through the drum or at an average flow rate lower than the second average flow rate.

2. The method according to claim 1, wherein at least one of the first or second drying phases of the drying phase is ended when one or more predetermined conditions indicating a laundry status is detected.

3. The method according to claim 1, wherein during the first drying phase rotation periods of the drum in the alternating main and counter rotation directions have a duration such that the drum is rotated less than 5 full turns, less than 3 turns, less than 1 turn or less than half turn.

4. The method according to claim 1, wherein during the first drying phase a total duration of drum rotation in the counter rotation direction is longer than a total duration of drum rotation in the main rotation direction, the duration of the periods of drum rotation in the main rotation direction is longer than the duration of a first rotation period of the first drying phase of drum rotation in the counterdirection, or a number of rotation periods of drum rotation in the counter rotation direction is higher than a number of periods of drum rotation in the main rotation direction.

5. The method according to claim 1, wherein a maximum drum rotation speed during the second drying phase is higher than a maximum drum rotation speed during the first drying phase.

6. The method according to claim 1, wherein a maximum drum rotation speed in the first drying phase is equal to or below 20, 15, 10, 8 or 5 rpm or below 0.5, 0.3 or 0.2 the maximum drum rotation speed of the second drying phase, or in the second drying phase is below the satellization speed or equal to or below 60, 54, 50, 45 or 40 rpm.

7. The method according to claim 1, wherein in a cooling phase for cooling the delicate laundry during a final portion of the drying cycle or during the anti-crease phase after the drying cycle a fourth phase is applied in which the drum is rotated or mainly rotated in the main rotation direction while the drying air (A) is conveyed at the second average flow rate through the drum or at an average flow rate higher than the first average flow rate.

8. The method according to claim 1, wherein the duration of the fourth phase is shorter than the duration of the second drying phase, or wherein the ratio of the duration of the fourth phase to the duration of the second drying phase is equal to or below 0.5, 0.4, 0.2, 0.1, 0.05 or 0.02.

9. The method according to claim 1, wherein in a cooling phase for cooling the delicate laundry during the final portion of the drying cycle or during the anti-crease phase after the drying cycle the heating element is switched off or deactivated.

10. The method according to claim 1, wherein during the first drying phase or at least temporarily during the first drying phase the heating element is switched off or operated at reduced power.

11. The method according to claim 1, wherein during the first drying phase the drum is stopped for time periods between the rotation in the main and counter rotation directions.

12. The method according to claim 1, wherein the drying cycle is operated for drying silk, and wherein the drying cycle is activated or selected to be performed in a drying apparatus through an input unit adapted to receive a user input to activate a delicate or silk treatment program, wherein such treatment program includes controlling the drying apparatus.

13. A drying apparatus, comprising:

a cabinet, a drum adapted to receive laundry to be dried, wherein the drum is rotatably supported in the cabinet, a drying air channel arranged to guide drying air (A) such that it passes through the drum for drying the laundry in the drum, a heating element arranged in the drying air channel for heating the drying air (A), a blower arranged in the drying air channel and adapted to convey the drying air (A) in the drying air channel, a drum motor adapted to rotate the drum selectively in a main rotation direction and in a counter rotation direction, and a control unit configured to control an execution of at least one drying cycle including a first portion in which the drum is rotated in the main rotation direction, and a drying phase sequence portion having a first and a second drying phase, wherein in the first drying phase of the drying phase sequence portion, the control unit controls the drum motor to rotate the drum alternately in the main rotation direction and the counter rotation direction, and to control the blower such that the drying air (A) is conveyed at a first average flow rate through the drum, wherein in the second drying phase of the drying phase sequence portion, the control unit is adapted to control the drum motor to rotate only in the main rotation direction, and to control the blower such that the drying air (A) is conveyed at a second average flow rate through the drum, and wherein the first average flow rate is lower than the second average flow rate, wherein after the drying phase sequence portion of the drying cycle, the control unit is further configured to apply an anti-crease phase in which the drum is rotated alternately in the main and the counter rotation direction while the drying air (A) is conveyed at the first average flow rate through the drum or at an average flow rate lower than the second average flow rate.

14. The drying apparatus according to claim 13, wherein the drying air channel guides the drying air (A) from at least one drum outlet to at least one drum inlet such that the drum and the drying air channel form a drying air loop.

15. The drying apparatus according to claim 13, further comprising a heat pump system having a refrigerant cooling element as a heating element, and a refrigerant heating element arranged in the drying air channel upstream of the heating element for cooling the drying air (A).

16. The drying apparatus according to claim 13, wherein the drum motor is a controllable speed motor such that the drum may be rotated at different predetermined speeds.

17. The drying apparatus according to claim 13, wherein the blower conveyance capacity is higher when the blower is rotated in a forward direction as compared to rotation at a same speed in a backward direction.

* * * * *